United States Patent [19]

Handler et al.

[11] 4,126,366

[45] Nov. 21, 1978

[54] ROTATABLE, MULTIPLE STORAGE BIN ASSEMBLY

[75] Inventors: Milton E. Handler, Northbrook; Richard Sylvan, Glenview, both of Ill.

[73] Assignee: Hirsh Company, Skokie, Ill.

[21] Appl. No.: 774,419

[22] Filed: Mar. 4, 1977

[51] Int. Cl.[2] ..... A47B 49/00; A47F 5/02

[52] U.S. Cl. ..... 312/252; 312/125; 312/202; 211/163; 108/152

[58] Field of Search ..... 312/252, 202, 125, 135, 312/42, 59; 108/107, 108, 95, 141, 152; 211/163, 78, 126

[56] References Cited

U.S. PATENT DOCUMENTS

| | | | |
|---|---|---|---|
| 872,942 | 12/1907 | Hutcheson et al. | 312/252 |
| 1,488,456 | 3/1924 | Harper | 312/DIG. 33 |
| 1,870,643 | 8/1932 | Peterson | 211/163 |
| 1,875,563 | 9/1932 | Cooke et al. | 211/163 |
| 2,673,781 | 3/1954 | Heisler | 312/252 |
| 2,749,198 | 6/1956 | Berber | 312/252 |
| 3,257,154 | 6/1966 | Lewis | 312/252 |
| 3,498,136 | 3/1970 | LeMay | 312/202 |
| 3,593,470 | 7/1971 | Francis | 108/152 |
| 3,734,341 | 5/1973 | Levenhagen | 211/126 |
| 3,850,487 | 11/1974 | Batchelor | 312/202 |
| 3,931,894 | 1/1976 | Murphy | 211/163 |
| 3,957,159 | 5/1976 | Radek | 211/163 |

*Primary Examiner*—Victor N. Sakran

*Attorney, Agent, or Firm*—Dressler, Goldsmith, Clement, Gordon & Shore, Ltd.

[57] ABSTRACT

Covered bins and a rotatable assembly for holding a plurality of them in a cantilevered array is provided wherein the bins may be easily removed and added as necessary. A bin support column having an exterior shape of a regular prism is mounted for rotation on a base. Each face of the support column has an array of vertically spaced pairs of prongs. Each pair of prongs engages and releasably secures a bin to the face of the column. Each bin has a bottom wall, two side walls, a forward wall, and a rearward wall. Each bin is mounted to the support column with its rearward wall adjacent a face of the column by means of two slots which receive the pair of prongs projecting from the face of the support column. Preferably, each bin has a cover which is hinged to open and close over the top of the bin and which is slidably engaged with the side walls of the bin to allow complete removal therefrom. A handle is provided on the top of the support column to permit carrying the bin assembly from place to place and the whole assembly is easily disassembled into substantially flat pieces for easy storage and shipping.

4 Claims, 8 Drawing Figures

3.
3.
10
12
14
16
18
20
22
24
26
27
28
29
34
36
38
40
46
48
50
52
53
54
56
62
66
68
74
82
86
88
90

ROTATABLE, MULTIPLE STORAGE BIN ASSEMBLY

BACKGROUND OF THE INVENTION

This invention relates to tray or bin systems in which a number of individual containers are mounted on a support structure. Such tray or bin systems are used in the home and in industry for storing small items in an organized and readily accessible manner. Typical of such items that are so stored are hardware, such as nuts, bolts, and screws and household items such as costume jewelry, sewing accessories, and other notions.

Hardware items, such as nuts, bolts, and screws, are typically stored in systems having individual drawers mounted in larger support assemblies or are stored in hoppers usually mounted on larger racks. Frequently, it is necessary or desirable to take a number of the hardware items to a particular work area without taking the whole assembly along. Thus, there is a need for providing bin assemblies wherein individual bins can be easily and quickly removed from the supporting system and taken to the work station. Although individual small drawers may be removed from an assembly and taken to a work station, the open top of such drawers presents a drawback in that the contents can easily be spilled. Therefore, there is a need to provide a bin assembly wherein the bins are individually covered and wherein the cover can be easily opened to provide access to the contents of the bin. It would also be desirable to provide a cover which could be completely removed from the top of the bin to allow access to the entire inside of the bin.

In some instances, it may be necessary to carry a number of containers of small articles to a work station. In this case, it would be desirable to provide an assembly with a plurality of containers which can be easily carried by an individual from place to place.

With drawer-type assemblies, the contents of a drawer cannot be visually determined unless the drawer is pulled out a sufficient amount. It would be desirable to provide a storage assembly which would allow visual inspection of the contents without requiring the observer to pull out drawers, lift up covers, etc.

In the interest of saving space, it would be desirable to provide a rotatable storage assembly which could be wall mounted or free standing from a relatively small base.

In order to permit great flexibility in arranging and organizing of the stored items, it would be desirable to provide a storage assembly with individual bins that could be easily interchanged with each other.

SUMMARY OF THE INVENTION

In the preferred embodiment, the storage assembly of the present invention has a bin support column with an exterior shape of a regular hexagonal prism. The top of the support column is provided with a handle and the bottom of the support column is mounted for rotation on a base. Each face of the support column has a plurality of vertically spaced pairs of prongs for holding storage bins engaged therewith. Each bin has a bottom, a pair of side walls, a front wall, and a rear wall. The rear wall has two slots which engage a pair of prongs on the support column and hold the bin with its rearward wall against the column. The bin is provided with a cover, a portion of which slides onto the top edge of the side walls at the rear of the bin to allow the cover to be completely removed from the bin, if desired. A forward portion of the cover is flexibly or hingeably secured to the slidable portion of the cover and can be opened by being pivoted at the hinge to permit access to the interior of the bin. Preferably, the cover has downwardly extending semi-rigid flanges which engage the side walls of the bin to provide a snap-lock engagement when the cover is closed on the bin. Preferably, the bin also has one or more dividing partitions which may be easily inserted into, and removed from, the bin as may be required.

Each bin can be easily removed from the pair of prongs on the support column and placed upon its bottom on a table or other flat surface, if desired. Each bin is just as easily replaced on the support column by engaging the slots on its rear wall with a pair of prongs on the face of the column. The bin may be replaced on the column at any location where there is an empty pair of prongs.

The whole assembly is easily fitted together and is held to the base for rotation thereon by a vertical shaft member.

Numerous other advantages and features of the present invention will become readily apparent from the following detailed description of the invention and embodiments thereof, from the claims, and from the accompanying drawings.

BRIEF DESCRIPTION OF THE DRAWINGS

In the accompanying drawings, forming part of the specification, and in which like numerals are employed to designate like parts throughout the same.

DESCRIPTION OF THE PREFERRED EMBODIMENT

Figures 1, 2:
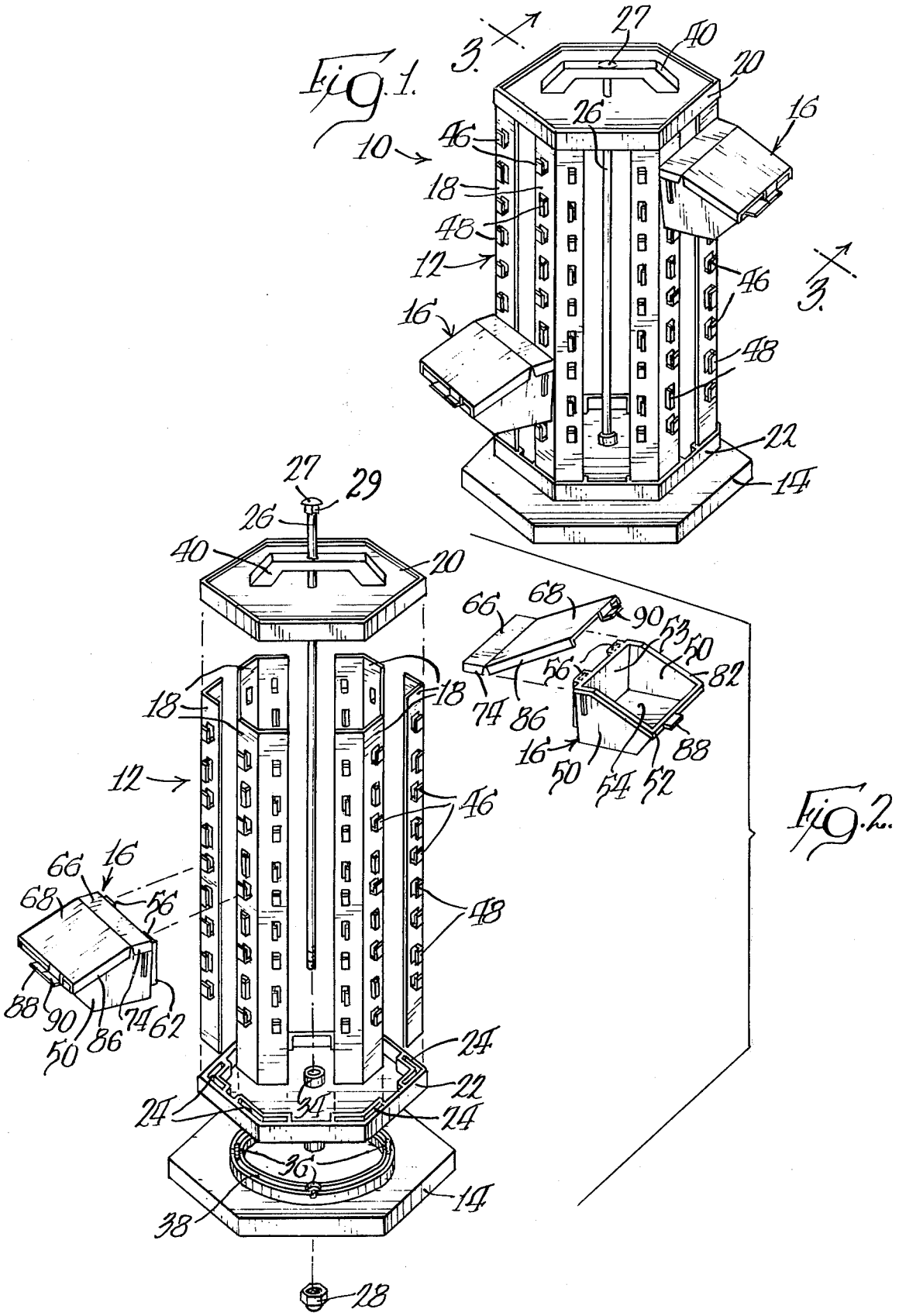
FIG. 1 is a perspective view of the storage bin assembly of the present invention.
FIG. 2 is an exploded, perspective view of the storage bin assembly of FIG. 1.

While this invention is susceptible of embodiment in many different forms, there is shown in the drawings and will herein be described in detail one specific embodiment, with the understanding that the present disclosure is to be considered as an exemplification of the principle of the invention and is not intended to limit the invention to the embodiment illustrated. The scope of the invention will be pointed out in the appended claims.

For ease of description, the apparatus of this invention will be described in a normal use position and terms such as upper, lower, horizontal, etc., will be used with reference to this normal position. It will be understood, however, that the apparatus of this invention may be manufactured, stored, transported, and sold in orientation other than the normal use position described.

The rotatable, multiple bin carrier or storage assembly of the present invention is illustrated in FIG. 1 and is generally designated 10 therein. A generally, free-standing vertical support column 12 is mounted on a base 14 and has a plurality of storage containers, trays, boxes, or bins 16 mounted thereon and extending outwardly therefrom. Two bins 16 are shown in FIG. 1, and it is to be understood that the support column 12 has a capability for supporting many more bins in a spaced vertical and circumferential array.

The support column 12 will now be described in more detail with specific reference to FIG. 2. The support column 12 comprises six separate column members 18. Each column member is preferably stamped from sheet metal and has two equal halves forming an included angle of about 120°. Each column member 18 is disposed endwise between a top hexagonal endpiece 20 and a bottom hexagonal endpiece 22. Preferably the endpieces 20 and 22 are plastic, though any suitable material may be used. Each column member 18 is located at a corner of the endpieces 20 and 22 to thus form an overall support column 12 which has an exterior configuration of a six-sided regular prism having a hexagonal cross-section. As is illustrated in FIG. 2, slots 24 are provided in the bottom endpiece 22 for receiving the lower ends of the column members 18. Similar slots are provided in the top endpiece 20 for receiving the upper ends of the column members 18 in like manner (not visible in FIG. 2).

Figure 3:
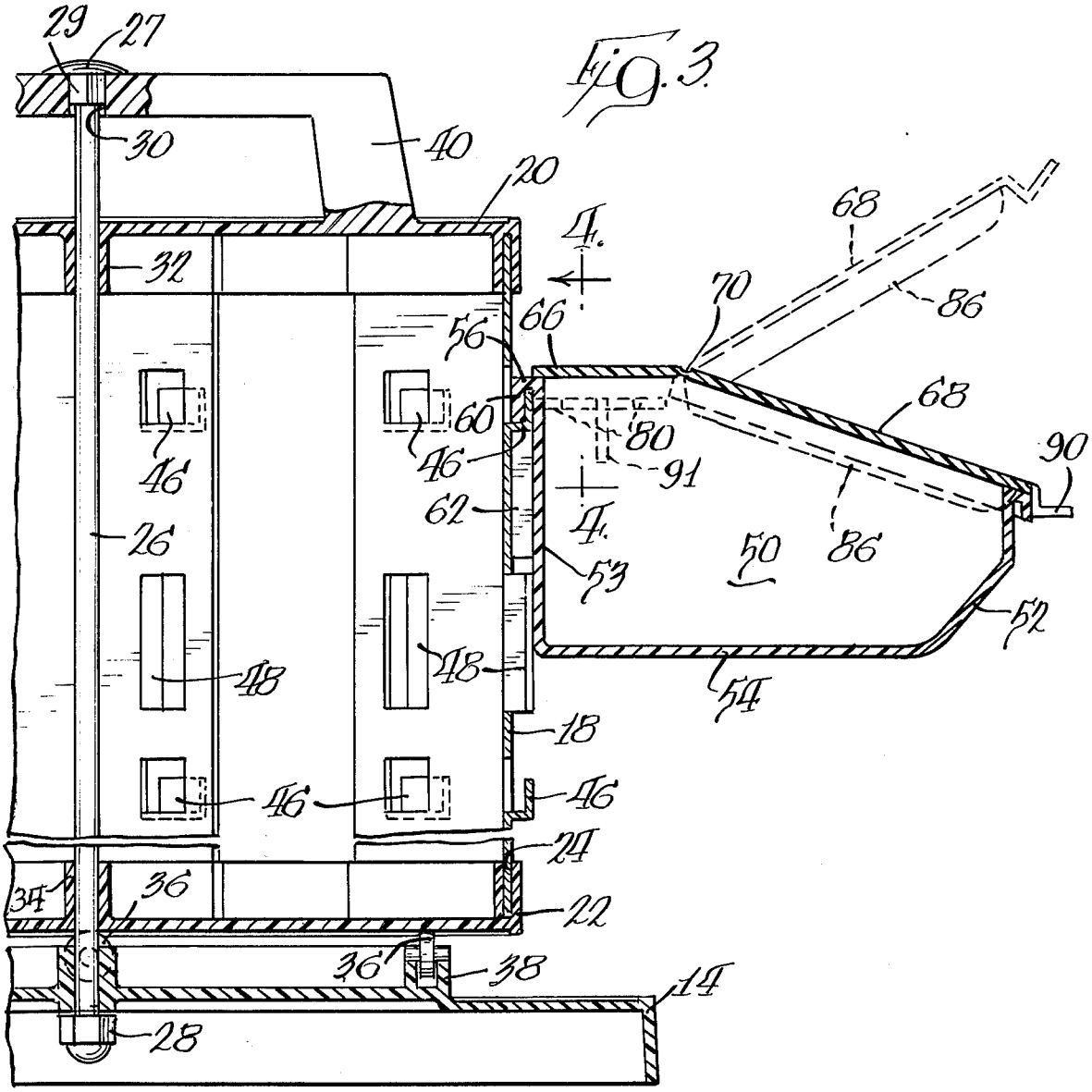
FIG. 3 is a fragmentary, enlarged, cross-sectional view taken generally along the plane 3—3 of FIG. 1.

The whole support column 12 rests on base 14 and is secured thereto by center shaft or stone bolt 26 with lower acorn nut 28 on the bottom end. The bolt 26 has a hemispherical head 27 with a square shank portion 29 just below the head. The square shank portion 29 is received in slot 30 of a handle 40 as best illustrated in FIG. 3. Journal bearing structures 32 and 34 are provided in the top endpieces 20 and bottom endpiece 22, respectively, as is best illustrated in FIG. 3, to accommodate rotation of the support column 12 about center shaft 26. The weight of the rotating support column 12, including the weight of the bins and contents, is transferred into base 14 by rollers 36 which are removably snap-mounted in track 38 as is best illustrated in FIGS. 2 and 3.

The storage assembly may be easily carried from place to place. To this end, a handle 40 is preferably integrally molded in the top surface of the top endpiece 20. Alternatively, a separate handle may be provided and held to end piece 20 by machine screws or other appropriate means.

The bins 16 are releasably secured to the faces of the support column 12 by pairs of prong means or prongs 46. The prongs 46 are arranged in horizontal or circumferential, vertically spaced rows. Each of the faces of the hexagon-shaped support column 12 has a pair of prongs 46 in each horizontal row which engage the back of a bin 16 to support the bin in a cantilevered manner as is illustrated in FIG. 1.

The bins 16 are preferably made of clear plastic to allow visual examination of the contents. As is best illustrated in FIG. 2, each bin has a pair of side walls 50, a front wall 52, a rear wall 53, and a bottom 54. The walls slant vertically upward from the bottom 54 to form a wide-mouthed receptacle having a greater cross-section at the top than at the bottom.

A novel structure is provided for mounting the bin 16 to the prongs 46 on the support column 16. A pair of slots 56 is provided on the rear wall 53 with a spacing between the slots to match the spacing between each prong 46 of a pair of prongs on the support column 12. The bin slots 56 are adapted to slidably receive the upwardly extending prongs 46 therein. With reference to FIG. 3, it can be seen that the prong 46 is received in the bin slot between the bin rear wall 53 and an outer slot wall 60. The bottom of the outer slot wall 60 engages or abuts the horizontal portion of the projecting prong 46.

A vertical spacer bar 62 is provided alongside each slot 56 and extends downwardly along the length of the rear wall 53 as is best illustrated in FIG. 2 (the closed bin 16 on the left-hand side) and in FIG. 3. Bar 62, of course, transfers much of the load of bin 16 and its contents to the individual column members 18 as the bin tends to pivot inwardly towards the support column 12 about the prongs 46. Further, the bar 62 prevents the rear wall 53 from being scratched or marred as the bin is engaged with, or disengaged from, the prongs 46 on the support column 12. This is of some importance since the rear wall is also preferably made of a clear plastic material to accommodate visual examination of the contents of the bin when the bin is removed from the support column 12.

A novel structure is incorporated in the support column 12 to reduce the probability of one of the bins being accidentally knocked out of engagement with the support prongs 46 when a bin immediately below it is lifted off of its prongs as it is removed from the support column. That is, there may be a tendency of a person, when lifting a bin off of the prongs, to lift the bin with more force than is necessary whereby causing the person's hand and/or bin to continue moving upwardly and accidentally hitting the bottom of the bin located immediately thereabove. Specifically, shear lugs 48 are arranged in horizontal or circumferential, vertically spaced rows in the faces of the hexagon-shaped support column 12. With reference to FIGS. 1, 2 and 3, it can be seen that each lug 48 projects outwardly from the face of the support column 12 between vertically spaced prongs 46. Thus, it can be seen that each lug 48 is located somewhat above a prong 46 and somewhat below another prong 46. The shear lugs 48 are spaced slightly inwardly of the outer edges of the prongs 46 so that when a bin 16 is engaged with a pair of prongs 46, the vertical spacer bar 62 on each side of the rear wall 53 of the bin 16 slide past the lugs 48. Though the lugs 48 are spaced just inwardly of the vertical spacer bar 62, they are located directly in line with the outer slot walls 60 of the bin which is supported on the prongs immediately below the lugs. Thus, if a person removes the bin immediately below a pair of lugs and accidentally raises the bin beyond a certain elevation, then the outer slot wall 60 will engage the bottom portion of the overhanging lug 48 and prevent the bin from being further raised and hitting the bottom of the overhanging bin immediately above. When removing a bin from the support column 12, if the top of the bin (specifically the outer slot wall 60) hits the overhanging lug 48, movement of the bin outwardly, generally perpendicular to the support column, will bring the bin free and clear of the support column and the immediately overhanging bin. Thus, the possibility of accidentally knocking the overhanging bin off of the support column is substantially reduced.

Figure 4:
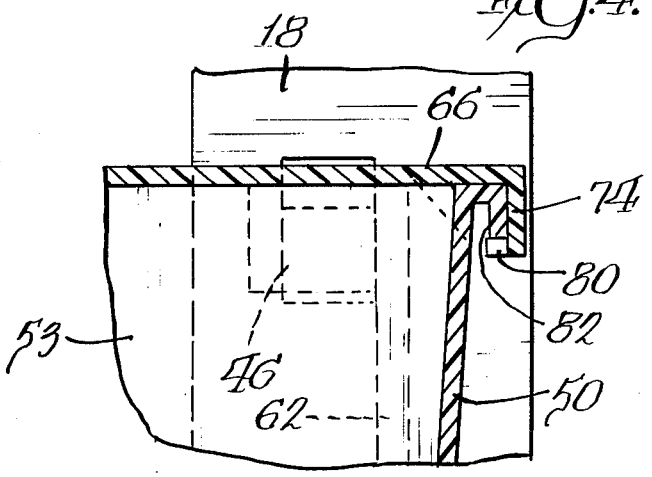
FIG. 4 is a fragmentary cross-sectional view taken generally along the plane 4—4 of FIG. 3.

A novel cover means is provided over the top of the bin 16. As is best illustrated in FIG. 3, the cover comprises a slidable mounting portion 66 and a movable or tilting portion 68 which is connected to the mounting portion 66 with a hinged means, preferably a flexible, plastic hinge 70. The plastic hinge 70 is basically a reduced cross-section, or reduced thickness portion of the plastic material which comprises the mounting portion 66 and tilting portion 68 of the cover. The tilting portion 68 is thus pivotable about hinge 70 from a closed position as shown by the solid line in FIG. 3 to an open position as shown by the dashed line in FIG. 3. As is best illustrated in FIG. 4, the slidable mounting portion 66 of the cover has depending side flanges 74. On each side of the bin, each side flange 74 has a pair of horizontally projecting lugs 80 as illustrated in FIG. 4 and as illustrated by dotted lines in FIG. 3. The flanges 74 and lugs 80 of the cover portion 66 engage an outwardly and downwardly extending mating flange 82 in sliding relationship to permit the cover to be slid rearwardly off of the bin 16 to allow access to the entire inner volume of the bin. When the cover is removed from the bin, it is slid straight back, essentially as illustrated in the exploded perspective view in the right-hand side of FIG. 2.

The tilting cover portion 68 preferably has downwardly depending flanges 86 also, as is best illustrated in FIG. 3. The flanges 86 are spaced apart on either side of the tilting cover portion 68 by an amount that permits the cover to close with the flanges in tight fitting engagement with the side wall flange structure 82 which continues around the entire periphery of the bin. The plastic material comprising the cover is preferably sufficiently flexible to allow the tilting covr portion 68 to tightly seal across the top of the bin and remain engaged thereagainst by the inherent resiliency of the cover flanges 86. To aid in removing the tilting cover portion 68 from the tight-fitting engagement with the bin, a pair of tabs can be provided, such as tab 88 on the bin front wall 52 and tab 90 on the tilting cover portion 68.

In necessary, the compartmentalization of the bin assembly can be further increased. For instance, the bin interior can be further divided, as with partitions (not shown) which may be slidably inserted into pairs of opposed vertical tracks or channels in the rear and front walls of the bin.

Figure 5:
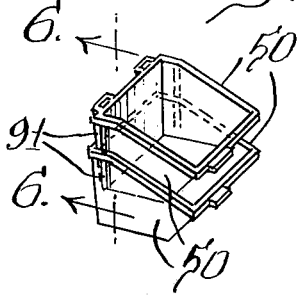
FIG. 5 is a perspective view of storage bins of the present invention in a stacked array.
Figure 6:
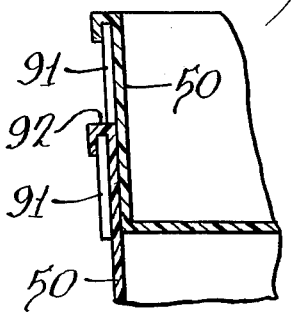
FIG. 6 is a fragmentary, enlarged, cross-sectional view taken generally along the plane 6—6 of FIG. 5.

The bins 16 are uniquely configured to allow them to be stacked one inside the other when their covers are removed. Since the walls of each bin are slanted outwardly and upwardly from the bottom of each bin as previously described, the bottom portion of one bin can be received in the mouth and upper portion of another bin to effect such stacking. With reference to FIGS. 5 and 6, there is shown a stack of two bins wherein an upper bin is received within a lower bin. A novel lug 91 is provided on each of the opposed side walls 50 to engage the top surface 92 of the rim of a lower bin. This prevents the bins from being pushed together, one inside the other, to such an extent that they become "stuck" and hard to pull apart.

Figure 7:
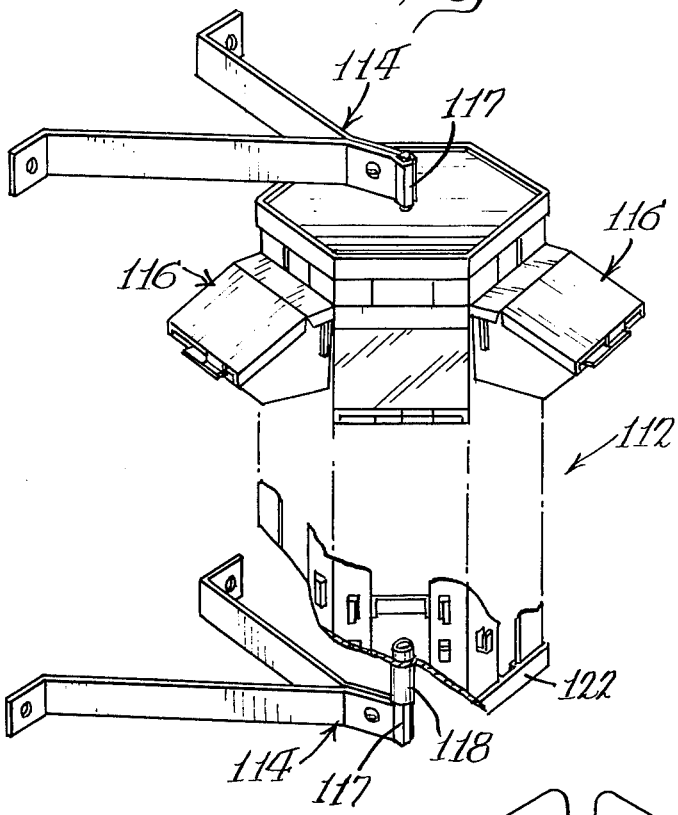
FIG. 7 is a perspective view of a modification of the storage bin assembly of the present invention.

A modification of the present invention is illustrated in FIG. 7. Here, a support column 112, similar to support column 12 illustrated in FIGS. 1 through 3 described above, is adapted for being wall mounted. The support 112 carries bins 116 and rotates about a central shaft axis. Both the support 112 and bins 116 are identical to the support 12 and bins 16, respectively, illustrated in FIGS. 1 through 3 previously described. Two-piece wall mounting brackets 114 are provided on the top and on the bottom of the support column and extend outwardly from a wall or other vertical surface (not shown). A separate shaft (not visible in FIG. 7) is mounted in clamped engagement within a two-piece sleeve or clamp 117 on one end of each bracket 114 so that one shaft extends into the top of the support column 112 and the other shaft extends into the bottom of the support column 112. A cylindrical spacer 118 is provided at the bottom of the support column 112 to keep the bottom endpiece 122 from bearing against the lower support bracket 114.

Figure 8:
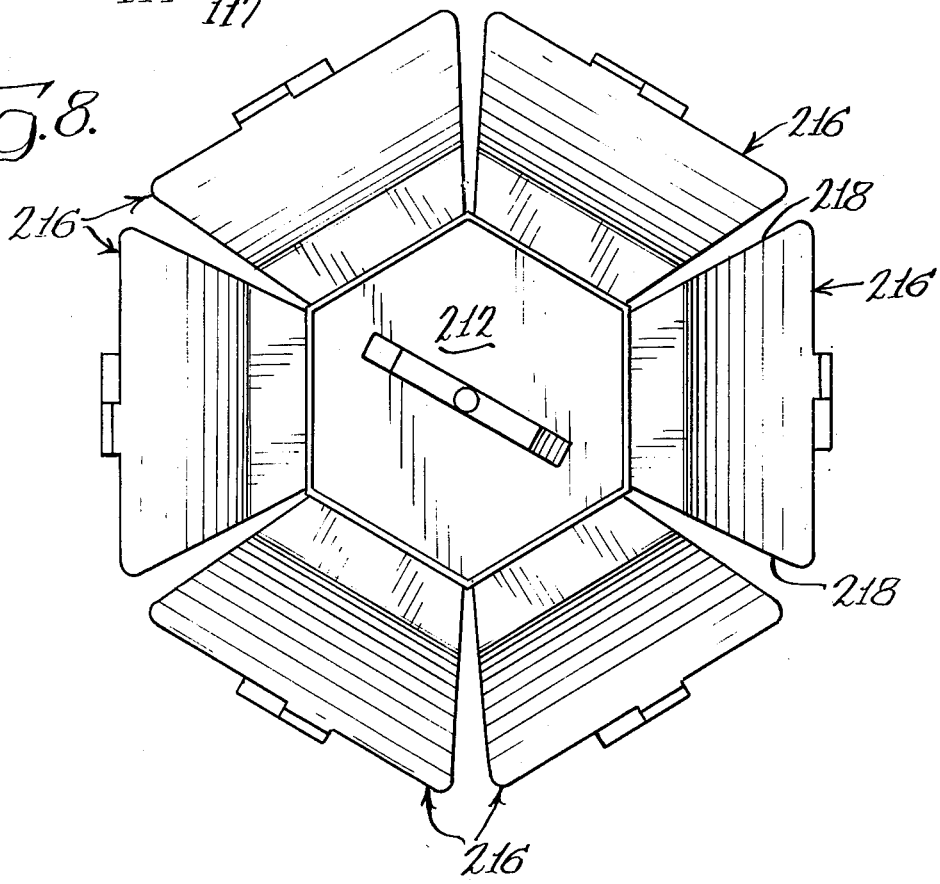
FIG. 8 is a top plan view of another modification of the storage bin assembly of the present invention.

FIG. 8 illustrates an alternate embodiment of the bins of the present invention. A support column 212, identical in configuration with the support column 12 illustrated in FIGS. 1 through 3 and previously described, holds a plurality of bins 216. Each bin is basically similar to the bin 16 illustrated in FIGS. 1 through 3 and previously described except that the side walls 218 are not parallel at the base of the bin as were the side walls 50 of the bin 16 illustrated in FIG. 2. Rather, the side walls 218 angle outwardly from the rear portion of the bin, thus extending the bin on either side into the space which went unoccupied in the first embodiment illustrated in FIGS. 1 through 3. Thus, for a given radius, this trapezoidal bin design provides increased volumetric capacity. Obviously, the bins 216 having the trapezoidal shape are interchangeable with, and can be used in conjunction with, bins 16 illustrated in FIGS. 1 through 3.

In summary, it is seen that the novel, multiple adjustable bin carrier or storage assembly of the present invention provides a novel means for securing bins to a rotating assembly and permits bins to be easily interchanged at will with other bins on the assembly. Further, the bins are preferably made of clear plastic to allow visual examination of their contents and, owing to the fact that they project outwardly from the support column, the contents of the bin can be viewed from many sides and directions. The bins are easily removable from the support column and can be carried to a work station separately. The unique and novel cover mechanism on each bin snap-locks into place over the bin opening and prevents the contents from spilling therefrom. A movable portion of the cover is easily opened to allow access to the interior and further, should it be necessary, the entire cover can be readily slid off of the bin completely. The support column and base assembly is seen to consist of just a few separate pieces which can be easily disassembled into a substantially flat package for storage or shipping. Assembly of the support column and base is quite easily accomplished and only one nut need be threadingly engaged with a center shaft to properly secure the entire support column and base as a completed assembly.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

I claim:

1. A rotatable assembly of multiple, removable, and interchangeable bins comprising:

a plurality of bins, each bin having a rear support wall defining a pair of slots for supporting said bin;

a base including an annular channel having a generally upwardly open U-shaped cross section and in which are mounted a plurality of cylindrical rollers each adapted to rotate about a fixed axis; and a bin support column mounted on said base for rotation relative thereto, said bin support column having a plurality of faces, each face having a plurality of pairs of prong means for engaging said pairs of bin slots to support said bins, each pair of prong means arranged in horizontal rows, said rows being vertically spaced on each said face, said bin support column including a bottom end piece presenting a substantially flat bearing surface adapted to be supported by and rotate relative to said rollers.

2. A rotatable, multiple storage bin carrier for supporting a plurality of bins, each of said bins having a rear support wall defining a pair of slots, said carrier comprising:

at least one center shaft and a bin support column mounted on said shaft for rotation thereto, said bin support column having a prismatic exterior surface presenting a plurality of faces, each face having a plurality of prong means arranged in pairs in horizontal rows for engaging pairs of said slots in said bins, said rows being vertically spaced on each face, each face further having a plurality of lugs arranged in pairs in horizontal rows, each of said lugs being vertically spaced on each face above one of said prong means, whereby when a bin is lifted off and vertically upward beyond a predetermined height above said prong means, the bin abuts at least one of said lugs and is thereby prevented from hitting the bottom of the overhanging bin.

3. A rotatable multiple storage bin carrier as set forth in claim 2 in which each said bin has a cover, said cover comprising (1) a first portion slidably engaging and removable from a rear portion of said bin and (2) a tilting portion hinged to said first portion and adapted to be swung upwardly away from said bin to allow access to the bin interior.

4. The assembly in accordance with claim 21 in which said first portion of said cover and said tilting portion of said cover each comprise a plate of transparent thermoplastic material of substantially the same thickness and in which said tilting portion and said first portion of said cover are connected by a reduced thickness of thermoplastic material to provide a flexible hinge therebetween.

* * * * *